US006759798B2

(12) United States Patent
Kim

(10) Patent No.: US 6,759,798 B2
(45) Date of Patent: Jul. 6, 2004

(54) STRUCTURE OF CAPSULE FOR RAPIDLY EXPANDING METALLIC MIXTURE

(76) Inventor: Chang Sun Kim, 358-7 Namchon-dong, Namdong-gu, Incheon-shi 405-100 (KR)

( * ) Notice: Subject to any disclaimer, the term of this patent is extended or adjusted under 35 U.S.C. 154(b) by 0 days.

(21) Appl. No.: 10/277,199

(22) Filed: Oct. 22, 2002

(65) Prior Publication Data

US 2003/0075068 A1 Apr. 24, 2003

(30) Foreign Application Priority Data

Oct. 23, 2001 (KR) ..... 2001-65451

(51) Int. Cl.[7] ..... H01J 5/50; F42C 19/22

(52) U.S. Cl. ..... 313/335; 102/202.5; 102/218; 313/341

(58) Field of Search ..... 315/32, 51, 124; 102/301, 206, 218, 202.5, 202.9; 313/326, 331, 335, 341

(56) References Cited

U.S. PATENT DOCUMENTS 3,175,492 A * 3/1965 Reyner et al. ..... 102/202.2
3,374,127 A * 3/1968 Jenner et al. ..... 149/39
4,070,970 A * 1/1978 Scamaton ..... 102/202.8
5,756,928 A * 5/1998 Ito et al. ..... 149/7
6,435,095 B1 * 8/2002 Menzel et al. ..... 102/275.7
6,578,493 B2 * 6/2003 Weise et al. ..... 102/472

* cited by examiner

*Primary Examiner*—Wilson Lee
*Assistant Examiner*—Thuy Vinh Tran
(74) *Attorney, Agent, or Firm*—Staas & Halsey LLP

(57) ABSTRACT

A structure of a capsule for a rapidly expanding metallic mixture includes one or more trigger electrode support rods arranged between the main trigger electrodes such that the trigger electrode support rods are linearly aligned with the main trigger electrodes, with an additional trigger electrode provided at each end of the trigger electrode support rods. Also, an electrolyte is added to the metallic mixture and the trigger electrodes are arranged at intervals of 1–100 mm and thus readily inducing arc discharge between the trigger electrodes. The capsule structure thus easily and effectively triggers an oxidation reaction of the metallic mixture even in the case of a long capsule.

14 Claims, 4 Drawing Sheets

STRUCTURE OF CAPSULE FOR RAPIDLY EXPANDING METALLIC MIXTURE

BACKGROUND OF THE INVENTION

1. Field of the Invention

The present invention is directed to a structure of a capsule for a rapidly expanding metallic mixture, capable of easily providing high temperatures required to initiate an oxidation reaction of the metallic mixture, due to high voltage applied from a high voltage generator.

2. Description of the Prior Art

The rapidly expanding metallic mixture used in the present invention was invented by the present inventors, and was patented by Korean Intellectual Property Office (Korean Patent No. 10-0213577).

The rapidly expanding metallic mixture disclosed in Korean Patent No. 10-0213577 can be defined as follows.

In a mixture of a metal salt and a metal powder subjected to a high temperature of 700° C. or more (about 1,500° C.) (as such, temperature to be applied varies with types and mixing ratios of metal salt and metal powder), while the metal salt allows the metal powder to be oxidized, oxidation heat of ultrahigh temperatures (3,000–30,000° C.) is instantaneously generated. When such a reaction is induced in a closed space, superhigh pressure of vaporization expansion (40,000–60,000 kg/cm$^2$) is generated due to the oxidation heat. Immediately after such expansion, volume shrinkage occurs. The present inventors confirmed the reaction results through repeated experiments involving the above reaction. In particular, the above reaction readily proceeds upon mixing of the metal salt and the light metal powder.

In this regard, when a mixture of ferric nitrate ($Fe(NO_3)_3$) and manganese (Mn) powder is subjected to a thermal shock of about 1500° C., the following reaction occurs.

$$2Fe(NO_3)_3+12Mn \rightarrow 2FeO+4Mn_3O_4+3N_2$$

In the above reaction, oxidation heat of 10,000° C. or higher is generated, by which iron (Fe) and manganese oxide ($Mn_3O_4$) products are vaporized and rapidly expanded. During vaporization and rapid expansion, a reverse reaction of the above reaction does not occur. When the volume becomes larger due to rapid expansion, internal temperature decreases. As such, iron (Fe) and manganese oxide ($Mn_3O_4$) are changed in state from gas to solid, and expansion pressure disappears instantaneously. According to a Charles' Law related to volume and temperature or a theory of adiabatic expansion, a phenomenon of temperature decrease due to rapid expansion can be explained.

Thus, the rapidly expanding metallic mixture is defined as a mixture comprising the metal salt as an oxidizing agent and the metal powder oxidized at high temperatures of 700° C. or more (about 1,500° C.) by the metal salt.

As such, the generated oxidation heat, which is ultrahigh temperature heat of 3,000–30,000° C., vaporization expands the product after oxidation, thus creating superhigh pressure of 40,000–60,000 kg/cm$^2$ in the closed space.

Such oxidation reaction and rapid expansion occurring only at such high temperature conditions suggest industrial applicability of the metallic mixture. Hence, the metallic mixture can be substituted for conventionally used dynamite, thus being suitable for use in blasting rock masses in construction works. Compared to dynamite, the metallic mixture of the present invention is much higher in expansion force and shorter in a time period required for oxidation. In addition, immediately after the condition of high temperature is removed by rapid expansion, the vaporization expanded product is changed to the solid state and thus expansion reaction stops. Therefore, there is no scattering of the broken fragments, and explosive sound during rapid expansion is remarkably reduced. The reason why conventional gunpowder and the inventive metallic mixture have different effects is that conventional gunpowder employs oxidation and vaporization of organic materials, whereas the rapidly expanding metallic mixture of the present invention uses oxidation and vaporization of metals. In such conventional gunpowder, even though the internal temperature is decreased after rapid expansion, gas products are not changed again to the solid state and diffused in the gaseous state. So, conventional gunpowder suffers from the disadvantages in terms of scattering many fragments, and creating a loud explosive sound and large explosive vibration. In addition, since typically used gunpowder may be fired even at relatively low temperatures of about 250° C., it should be carefully handled during transport and storage. However, the inventive metallic mixture is advantageous in light of no possibility of accidental explosion during storage and handling of the materials due to the oxidation reaction being generated only at high temperatures not easily applied.

As the above metal salt, metal nitrates are most preferable, but the invention is not limited thereto. In addition, the metal salts are exemplified by metal oxides, metal hydroxides, metal carbonates, metal sulfates and metal perchlorates. Such a metal salt may be used alone or in combinations thereof. In particular, the metal nitrates may be further added with at least one metal salt selected from among metal oxides, metal hydroxides, metal sulfates, and metal perchlorates, to control the temperature required for initiation of oxidation and the time period required for oxidation.

The metal nitrates include, but are not limited to, ferric nitrate ($Fe(NO_3)_3$), copper nitrate ($Cu(NO_3)_2$), barium nitrate ($Ba(NO_3)_2$), manganese nitrate ($Mn(NO_3)_4$), magnesium nitrate ($Mg(NO_3)_2$), potassium nitrate ($KNO_3$), sodium nitrate ($NaNO_3$), calcium nitrate ($Ca(NO_3)_2$), and combinations thereof.

The metal oxides include, but are not limited to, manganese oxide ($Mn_3O_4$), calcium oxide (CaO), titanium oxide ($TiO_2$), manganese dioxide ($MnO_2$), chromium oxide ($Cr_2O_3$), ferric oxide ($Fe_2O_3$), triiron tetroxide ($Fe_3O_4$), nickel oxide (NiO), copper oxide (CuO), zinc oxide (ZnO), potassium oxide ($K_2O$), sodium oxide ($Na_2O$), dinickel trioxide ($Ni_2O_3$), lead oxide (PbO), lithium oxide ($Li_2O$), barium oxide (BaO), strontium oxide (SrO), boron oxide ($B_2O_3$), and combinations thereof.

The metal hydroxides include, but are not limited to, lithium hydroxide (LiOH), potassium hydroxide (KOH), sodium hydroxide (NaOH), calcium hydroxide ($Ca(OH)_2$), barium hydroxide ($Ba(OH)_2$), strontium hydroxide ($Sr(OH)_2$), zinc hydroxide ($Zn(OH)_2$), ferric hydroxide ($Fe(OH)_3$), copper hydroxide ($Cu(OH)_2$), nickel hydroxide ($Ni(OH)_2$), manganese hydroxide ($Mn(OH)_3$), chromium hydroxide ($Cr(OH)_3$), magnesium hydroxide (MgOH), and combinations thereof.

The metal carbonates include, but are not limited to, lithium carbonate ($Li_2CO_3$), potassium carbonate ($K_2CO_3$), sodium carbonate ($Na_2CO_3$), calcium carbonate ($CaCO_3$), barium carbonate ($BaCO_3$), strontium carbonate ($SrCO_3$), zinc carbonate ($ZnCO_3$), ferrous carbonate ($FeCO_3$), copper carbonate ($CUCO_3$), nickel carbonate ($NiCO_3$), manganese carbonate ($MnCO_3$), chromium carbonate ($CrCO_3$), magnesium carbonate ($MgCO_3$), and combinations thereof.

The metal sulfates include, but are not limited to, potassium sulfate ($K_2SO_4$), lithium sulfate ($Li_2SO_4$), sodium sulfate ($Na_2SO_4$), calcium sulfate ($CaSO_4$), barium sulfate ($BaSO_4$), strontium sulfate ($SrSO_4$), zinc sulfate ($ZnSO_4$), ferrous sulfate ($FeSO_4$), copper sulfate ($CuSO_4$), nickel sulfate ($NiSO_4$), aluminum sulfate ($Al_2(SO_4)_3$), manganese sulfate ($MnSO_4$), magnesium sulfate ($MgSO_4$), chromium sulfate ($CrSO_4$), and combinations thereof.

The metal perchlorates include, but are not limited to, potassium perchlorate ($KClO_4$), lithium perchlorate ($LiClO_4$), sodium perchlorate ($NaClO_4$), calcium perchlorate ($Ca(ClO_4)_2$), barium perchlorate ($Ba(ClO_4)_2$), zinc perchlorate ($Zn(ClO_4)_2$), ferrous perchlorate ($Fe(ClO_4)_3$), manganese perchlorate ($Mn(ClO_4)_2$), magnesium perchloratee ($Mg(ClO_4)_2$), and combinations thereof.

The metal powder is preferably selected from the group consisting of aluminum (Al) powder, sodium (Na) powder, potassium (K) powder, lithium (Li) powder, magnesium (Mg) powder, calcium (Ca) powder, manganese (Mn) powder, barium (Ba) powder, chromium (Cr) powder, silicon (Si) powder, and combinations thereof.

A mixing ratio of the metal salt and the metal powder is defined as a ratio of oxygen amounts generated from the metal salts and oxygen amounts required for oxidization of metal powders, which is a ratio of molecular weights calculated from chemical formulas. The time period required for oxidation of the metal powder in each capsule is a moment in the range of 1/2,000 to 1/100 sec.

The composition, function and preparation process of the rapidly expanding metallic mixture is specifically disclosed in Korean Pat. No. 10-0213577. In the present invention, which is to allow industrial applicability of the rapidly expanding metallic mixture disclosed in Korean Pat. No. 10-0213577, the metallic mixture itself is not further described.

The condition of high temperature required to trigger the oxidation reaction may be provided by a variety of methods. Particularly, the present invention provides a capsule structure for a rapidly expanding metallic mixture, in which high voltage arc-discharge heat can be used as a heat source. In the case of applying arc discharge, temperatures reaching several thousands of degrees (° C.) may be easily generated.

SUMMARY OF THE INVENTION

The present invention concerns a capsule structure for a rapidly expanding metallic mixture, capable of applying a high temperature required for triggering of oxidation reaction, to the rapidly expanding metallic mixture.

Therefore, it is an object of the present invention to provide a capsule for a rapidly expanding metallic mixture, which has a structure capable of easily providing the triggering temperature required for initiation of an oxidation reaction of the metallic mixture.

Another object of the present invention is to provide a capsule for a rapidly expanding metallic mixture, which has a structure capable of easily and effectively triggering an oxidation reaction of the metallic mixture, even in the case of a long capsule, the structure also inducing an effective arc discharge as well as generating sparks at several points even with the use of low voltage.

A further object of the present invention is to provide a capsule for a rapidly expanding metallic mixture, which has a structure capable of minimizing the diameter of the capsule installation hole, drilled in a target material to be blasted, and allowing an easy insertion of the capsule into the capsule installation hole.

In order to accomplish the above objects, the present invention provides a structure of the capsule for a rapidly expanding metallic mixture, comprising: an outer casing made of an insulating material; a rapidly expanding mixture contained in the outer casing; a pair of main trigger electrodes for inducing arc discharge, the main trigger electrodes being embedded in the metallic mixture; and a pair of power supply rods electrically connected to the main trigger electrodes, respectively, so as to apply high voltage from an external high voltage generator to the main trigger electrodes.

When using a long capsule, the capsule structure preferably comprises one or more trigger electrode support rods arranged between the main trigger electrodes, such that the trigger electrode support rods are linearly aligned with the main trigger electrodes, with an additional trigger electrode provided at each end of the trigger electrode support rods. In such a case, it is possible to effectively induce arc discharge at several points even with the use of low voltage, as well as preferably reducing the length of resistance wires. In the capsule structure with the trigger electrode support rods, an insulating support base is provided in the metallic mixture inside the outer casing, and one or more rod supports respectively extend from the insulating support base to the trigger electrode support rods, thus supporting the trigger electrode support rods, such that the trigger electrode support rods are linearly aligned with the main trigger electrodes.

In the capsule structure, a resistance wire is connected between adjacent trigger electrodes so as to induce arc discharge between the trigger electrodes via rapid heating, melting and evaporation when high voltage is applied to the trigger electrodes. Due to such resistance wires, it is easy to induce the arc discharge between the trigger electrodes.

In addition, it is preferable to add an electrolyte to the metallic mixture and arrange the trigger electrodes at intervals of 1–100 mm, and, in such a case, the arc discharge is readily induced between the trigger electrodes even without a resistance wire.

The power supply rods may lead outward from both ends of the outer casing, respectively. This structure simplifies the internal construction of the capsule, but is problematic in that it complicates the manipulation of the capsule, as well as requiring an enlargement in the diameter of the capsule installation hole, formed on the target material to be blasted.

Alternatively, all the power supply rods may lead outward from one end of the outer casing. This structure allows easy manipulation of the capsule, as well as allowing a reduction in the diameter of the capsule installation hole formed in the target material to be blasted, but is problematic in that it complicates the internal construction of the capsule.

The rapidly expanding metallic mixture, contained in the capsule, comprises a mixture of a metal powder with a metal salt responsible for oxidation of the metal powder at high temperatures of 700° C. or more (about 1,500° C.).

The metal salt of the mixture is selected from among metal nitrates, metal oxides, metal hydroxides, metal carbonates, metal sulfates, metal perchlorates, and combinations thereof.

The metal powder of the mixture is selected from among aluminum (Al), sodium (Na), potassium (K), lithium (Li), magnesium (Mg), calcium (Ca), manganese (Mn), barium (Ba), chromium (Cr), silicon (Si), and combinations thereof.

The rapidly expanding metallic mixture is further added with a water repellent such as oil or an inorganic preservative, to prevent oxidation of the metal powder during storage. In addition, particles of the rapidly expanding metallic mixture are coated with a resin and formed to the volume of 0.1–100 $mm^3$, and then introduced into the outer casing, thereby preventing oxidation of the metal powder.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
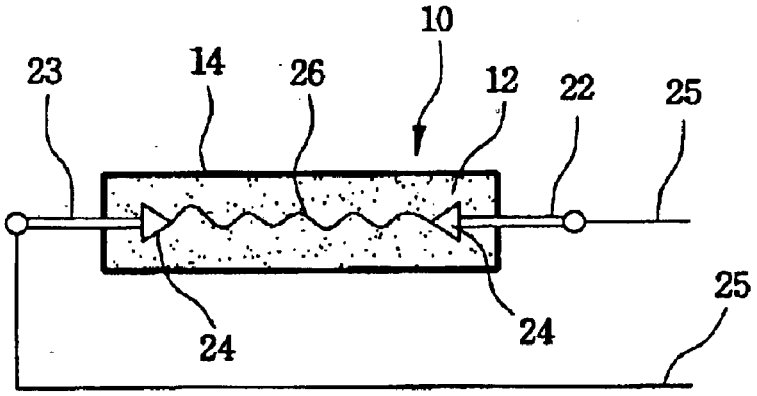
FIG. 1 is a view showing the structure of a capsule for a rapidly expanding metallic mixture in accordance with the primary embodiment of the present invention.

Reference should now be made to the drawings, in which the same reference numerals are used throughout the different drawings to designate the same or similar components.

Figure 2:
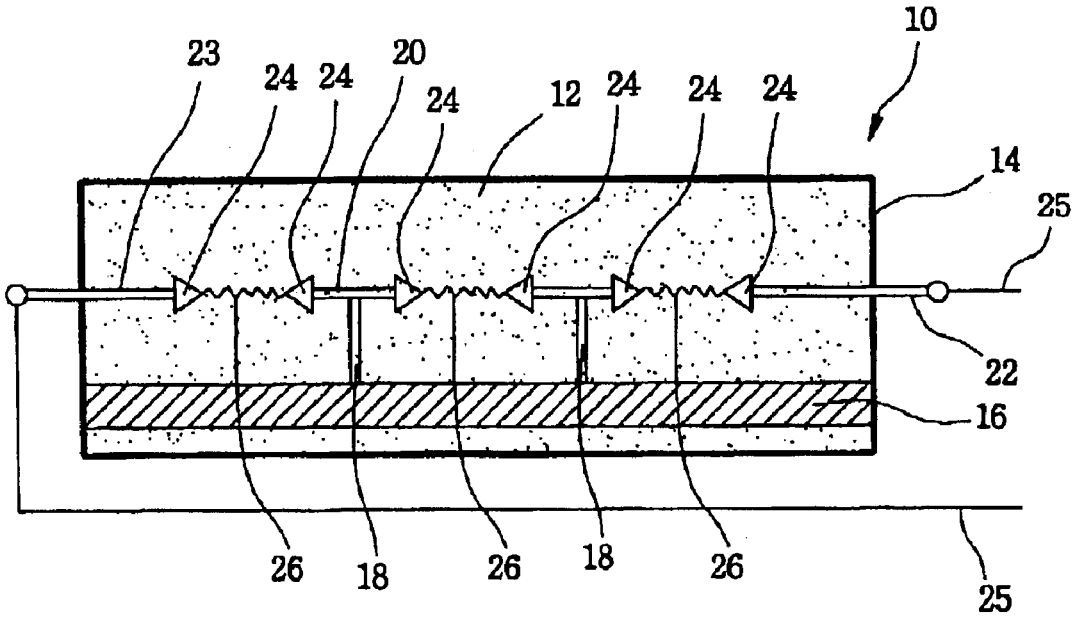
FIG. 2 is a view showing the structure of a capsule for a rapidly expanding metallic mixture in accordance with the second embodiment of the present invention.
Figure 3:
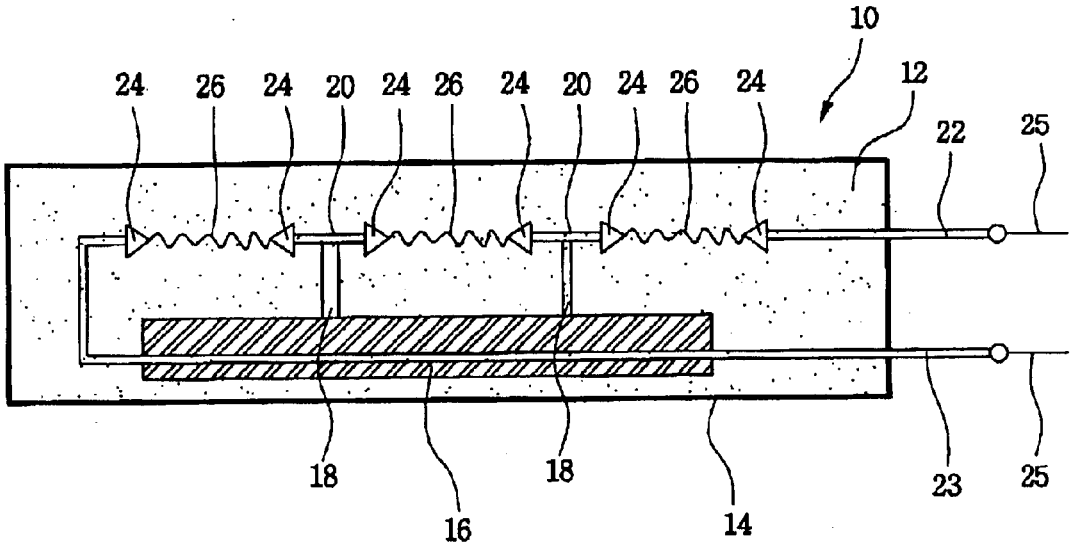
FIG. 3 is a view showing the structure of a capsule for a rapidly expanding metallic mixture in accordance with the third embodiment of the present invention.
Figure 4:
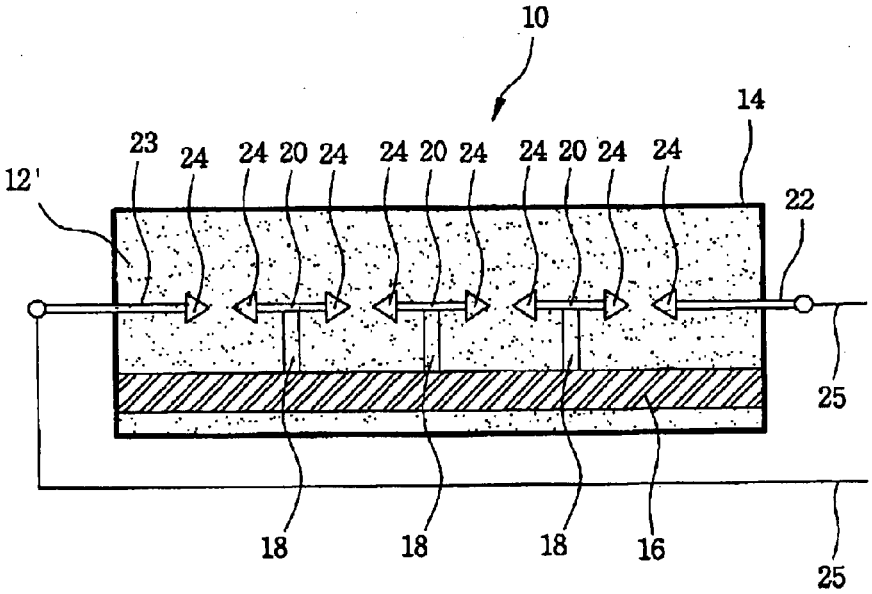
FIG. 4 is a view showing the structure of a capsule for a rapidly expanding metallic mixture in accordance with the fourth embodiment of the present invention.
Figure 5:
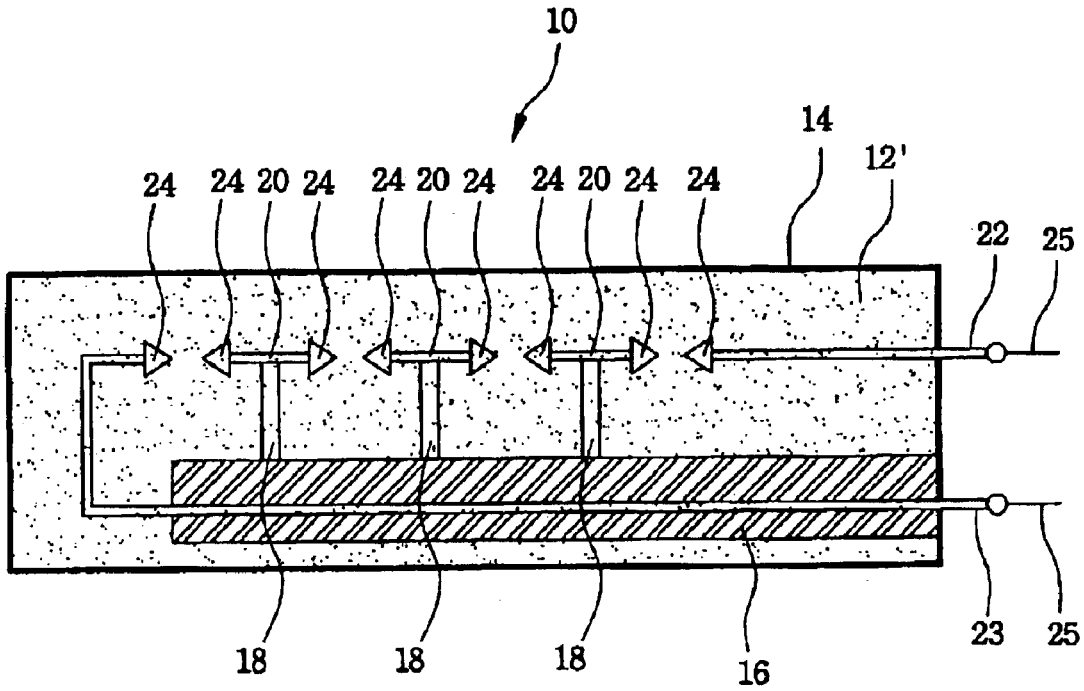
FIG. 5 is a view showing the structure of a capsule for a rapidly expanding metallic mixture in accordance with the fifth embodiment of the present invention.
Figure 6:
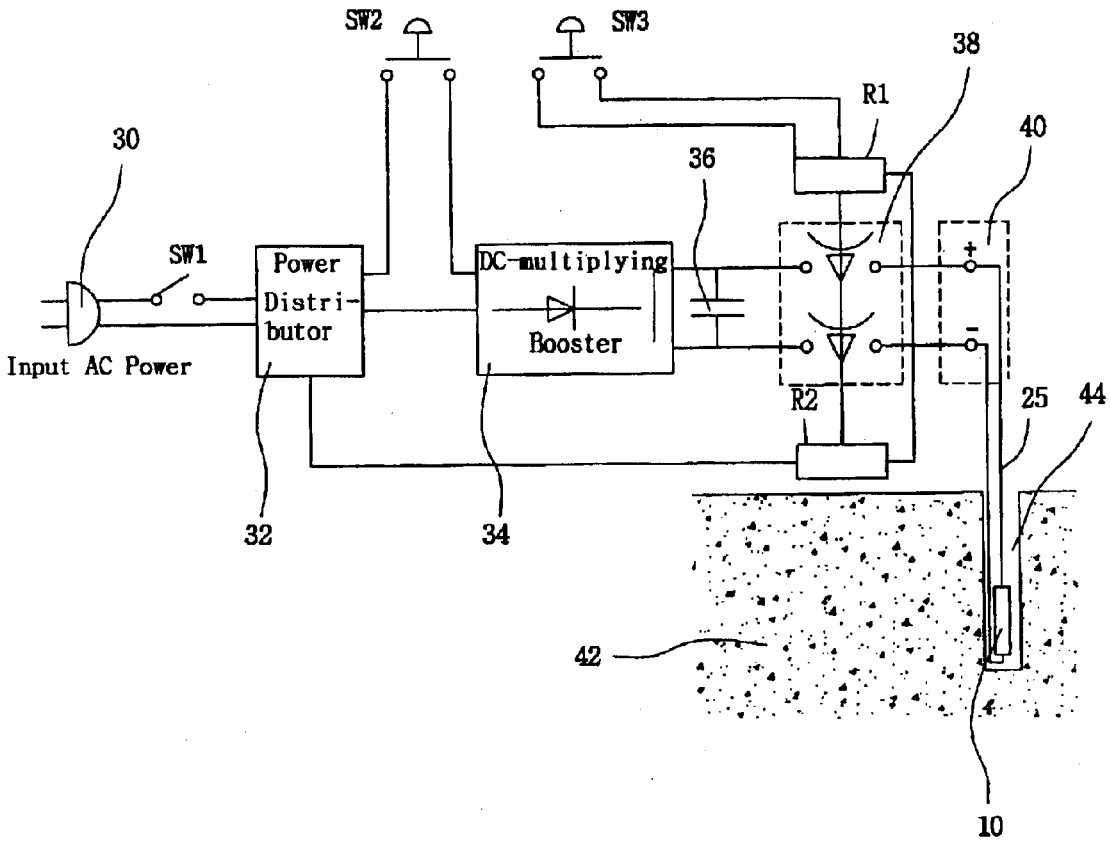
FIG. 6 is a circuit diagram of a high voltage generator used for applying high voltage to the capsule of the present invention.

FIGS. 1 to 5 show the capsule structures for a rapidly expanding metallic mixture in accordance with the present invention, in which FIG. 1 shows the capsule of the primary embodiment, FIG. 2 shows the capsule of the second embodiment, FIG. 3 shows the capsule of the third embodiment, FIG. 4 shows the capsule of the fourth embodiment, and FIG. 5 shows the capsule of the fifth embodiment. FIG. 6 is a circuit diagram of a high voltage generator used for applying high voltage to the capsule of the present invention.

The capsule for a rapidly expanding metallic mixture shown in FIG. 1 is designed in accordance with the primary embodiment of the present invention, and has the most basic and simple structure.

As shown in the drawing, the capsule 10 for a rapidly expanding metallic mixture according to the primary embodiment comprises an outer casing 14 made of an insulating material, with the rapidly expanding mixture 12 contained in the outer casing 14, and two power supply rods 22 and 23 leading outward from both ends of the outer casing 14, respectively. Two main trigger electrodes 24 for inducing arc discharge are provided at the inner ends of the two power supply rods 22 and 23, respectively. The two main trigger electrodes 24 induce arc discharge between them when high voltage is applied thereto. The insulating outer casing 14 is made of paper tubes, plastic tubes, or ceramic tubes, and is sealed at both ends. The main trigger electrodes 24 are embedded in the metallic mixture 12. In the present invention, each main trigger electrode and an associated power supply rod may be integrally formed as a single structure. Alternatively, the main trigger electrode and an associated power supply rod may be separately produced, prior to being integrated into a single structure. The power supply rods 22 and 23 and the main trigger electrodes 24 for inducing the arc discharge are preferably made of conductive metals, such as copper. The shapes of rods and electrodes may be cylinder-like or plate-like. When a high voltage of 2 kV or more is applied to the two power supply rods 22 and 23, arc discharge is induced between the two trigger electrodes 24, thus instantaneously generating a high temperature of about 2,000° C. or more at positions around the positive and negative trigger electrodes.

As shown in FIG. 1, a resistance wire 26 is preferably connected between the two trigger electrodes 24 so as to more easily induce arc discharge between the trigger electrodes 24 by rapid heating, melting and evaporation when high voltage is applied to the trigger electrodes 24. As such, the resistance wire is preferably made of nichrome or tungsten. When the capsule has such a resistance wire 26, it is possible to effectively and reliably induce arc discharge between the two trigger electrodes 24 even though the two electrodes 24 are spaced apart from each other at a longer interval.

When an electrolyte is further added to the rapidly expanding metallic mixture 12 and the trigger electrodes 24 are arranged at an interval of 1–100 mm, arc discharge can be readily induced even without a resistance wire 26. As such, small amounts of ammonium borate, nitrates, and sulfates are dissolved in alcohol, such as glycerin or ethylene glycol, and preferably used as the electrolyte.

The high voltage generator, used for supplying high voltage to the main trigger electrodes 24 through the power supply rods 22 and 23, comprises an electric circuit including a power distributor 32, a DC-multiplying booster 34, a charger 36, and a momentary switch 38, as shown in FIG. 6. In the high voltage generator, the power distributor 32 distributes input AC power 30 to parts of the high voltage generator, while the DC-multiplying booster 34 multiplies and DC boosts the input AC power distributed thereto. The boosted DC voltage is charged as a high level of voltage in the charger 36. The momentary switch 38 supplies the charged high voltage to electric wires leading to the outside of the high voltage generator when the switch 38 is momentarily closed. When it is desired to connect the high voltage generator to a capsule 10 of the present invention and use the generator with the capsule 10 in blasting applications, the positive and negative terminals of the switch 38 are connected through a connector 40 to electric wires 25 extending from the power supply rods 22 and 23 of the capsule 10 set in a capsule installation hole 44 formed in the target material 42 to be blasted. After the electric connection of the high voltage generator to the capsule 10, the generator applies high voltage to the trigger electrodes of the capsule 10 under control of the switch 38, thus causing oxidation and rapid expansion of the metallic mixture in the capsule 10. Of course, the above-mentioned electric circuit construction of the high voltage generator used in the present invention may be substituted with an equivalent circuit construction without affecting the functioning of the present invention. It is thus apparent that the construction of the high voltage generator is not included in the gist of the present invention.

FIG. 2 shows a capsule according to the second embodiment of the present invention. As shown in the drawing, the capsule 10 of the second embodiment comprises two or more pairs of trigger electrodes 24 which are arranged between the two power supply rods 22 and 23, in a series. In such a case, except for the two main trigger electrodes 24 provided at the inner ends of the two power supply rods 22 and 23, the additional trigger electrodes 24 are formed at both ends of one or more trigger electrode support rods 20 embedded in the metallic mixture 12. In other words, in the capsule 10 of the second embodiment, one or more trigger electrode support rods 20 are arranged between the two main trigger electrodes 24 of the two power supply rods 22 and 23 such that the electrode support rods 20 are linearly aligned with the main trigger electrodes 24, with an additional trigger electrode 24 provided at each end of the electrode support rods 20.

In a detailed description with reference to FIG. 2, the capsule for a rapidly expanding metallic mixture according to the second embodiment comprises a sealed insulating outer casing 14, with the rapidly expanding mixture 12 contained in the outer casing 14. An insulating support base 16 is provided in the metallic mixture 12 inside the outer casing 14. One or more rod supports 18 respectively extend perpendicularly from the insulating support base 16 to a predetermined length. One or more trigger electrode support rods 20 are installed at ends of the rod supports 18 such that the electrode support rods 20 are arranged in parallel to the support base 16 while being spaced at regular intervals. Two power supply rods 22 and 23 lead outward from both ends of the outer casing 14 so as to be connected to the high voltage generator through electric wires 25. Two or more pairs of trigger electrodes 24 are provided at the inner ends of the two power supply rods 22 and 23 and at both ends of the electrode support rods 20 embedded in the metallic mixture 12, such that all the trigger electrodes 24 are arranged in a series. In addition, a resistance wire 26 is electrically connected between adjacent trigger electrodes 24.

In the capsule 10 according to the second embodiment of the present invention, the rapidly expanding metallic mixture 12 is contained in the outer casing 14 fabricated in the form of an appropriate shape, such as a cylindrical shape, and sealed at both ends. In addition, the insulating support base 16 is axially arranged in the metallic mixture 12 inside the outer casing 14. One or more rod supports 18 perpendicularly extend from the support base 16 at positions spaced at regular intervals, and one or more trigger electrode support rods 20 are fixed to the ends of the rod supports 18 such that the electrode support rods 20 are arranged at regular intervals and extend in parallel to the support base 16. Two power supply rods 22 and 23 lead outward from both ends of the outer casing 14. A plurality of trigger electrodes 24 are provided at the inner ends of the two power supply rods 22 and 23, and at both ends of the electrode support rods 20 in such a way that the electrode support rods 20, trigger electrodes 24, and the power supply rods 22 and 23 are arranged along a line. A resistance wire 26 is electrically connected between adjacent trigger electrodes 24 to accomplish the electric connection between the trigger electrodes 24. When high voltage is applied to the power supply rods 22 and 23, the resistance wires 26 connected to the trigger electrodes 24 are rapidly heated, melted and evaporated and the leakage current (arc) is induced between adjacent trigger electrodes 24. Arc discharge is thus induced between the trigger electrodes 24, and a high temperature capable of triggering the oxidation of metal powder by metal salt is generated at an area around each trigger electrode 24. Therefore, an oxidation reaction of the rapidly expanding metallic mixture 12 is initiated.

The capsule structure according to the second embodiment is particularly useful to a long capsule. When the above capsule structure is used in such a long capsule, it is possible to effectively induce arc discharge and sparks at several points, as well as preferably lowering the level of voltage applied to the capsule. When the trigger electrodes are spaced out at intervals of 200 mm or more, it is necessary to apply a voltage of 6–7 kV or more to the trigger electrodes so as to induce effect arc discharge between the electrodes. However, in the case of trigger electrodes spaced out at intervals of 100 mm or less, such effective arc discharge between the electrodes is induced even with the use of a voltage of 3–4 kV. Of course, it should be understood that the level of voltage to be applied to the trigger electrodes for inducing effective arc discharge between said electrodes somewhat varies in accordance with other conditions, such as kinds of resistance wires, as well as kinds and concentrations of electrolytes.

FIG. 3 shows a capsule according to the third embodiment of the present invention. As shown in the drawing, the general shape of the capsule 10 according to the third embodiment is similar to that of the second embodiment, but the capsule 10 of the third embodiment is altered to lead the two power supply rods 22 and 23 to the outside through one end of the outer casing 14. That is, different from the capsule according to the second embodiment with the two power supply rods 22 and 23 respectively leading to the outside through both ends of the outer casing 14, one of the two power supply rods 22 and 23 according to the third embodiment, that is, the power supply rod 23 passes the insulating support base 16 inside the metallic mixture 12, prior to being led to the outside through the end of the outer casing 14 having the other power supply rod 22. In other words, in the capsules 10 according to the primary and second embodiments, the power supply rod 23 with a positive terminal leads to the outside through the left-handed end of the outer casing 14 as shown in FIGS. 1 and 2, and the power supply rod 22 with a negative terminal leads to the outside through the right-handed end of the casing 14. However, in the capsule 10 according to the third embodiment, both power supply rods 23 lead to the outside through the right-handed end of the outer casing 14 as shown in FIG. 3. When installing a capsule 10 of the present invention at a blasting area, a capsule installation hole 44 is drilled in the target material 42 to be blasted, such as a rock mass, and the capsule 10 is axially inserted into the hole 44 such that only the electric wires 25 connected to the power supply rods 22 and 23 lead to the outside of the hole 44. Thereafter, the remaining space of the hole 44 is plugged with an appropriate plugging material, such as cement mortar, so as to seal the hole 44. In the case of a capsule 10 with the two power supply rods 22 and 23 leading to the outside through both ends of the outer casing 14, it is necessary to form a large diameter hole 44, resulting in a large remaining space to be plugged with a plugging material after the installation of the capsule 10 in the hole 44, as showing in FIG. 6. However, when the capsule 10 is designed such that the two power supply rods 22 and 23 lead to the outside through one end of the outer casing 14, as described in the third embodiment, it is possible to preferably reduce the diameter of the hole 44, resulting in a reduction in the remaining space to be plugged. Therefore, the drilling and plugging work for capsule installation holes is simplified, so work efficiency while drilling and plugging is improved. Such an arrangement of the two power supply rods on one end of the outer casing is specifically useful in the case of long capsules. However, it should be understood that the power supply rod arrangement according to the third embodiment may be also preferably adopted in a small- or medium-sized capsule of the primary embodiment.

FIG. 4 shows a capsule according to the fourth embodiment of the present invention. As shown in the drawing, the general shape of the capsule 10 according to the fourth embodiment remains the same as that described in the second embodiment, but the capsule 10 of the fourth embodiment is altered such that an electrolyte capable of inducing arc discharge is added to the metallic mixture 12, thus removing the resistance wires 26 from the capsule. In the capsule 10 of the fourth embodiment, the trigger electrodes 24 are preferably arranged at intervals of 1–100 mm. The capsule 10 according to the fourth embodiment comprises a sealed insulating outer casing 14, with a rapidly expanding mixture 12 added with the electrolyte contained in the outer casing 14. An insulating support base 16 is axially arranged in the metallic mixture 12 inside the outer casing 14, while one or more rod supports 18 perpendicularly extend from the support base 16 at positions spaced at regular intervals. One or more trigger electrode support rods 20 are fixed to the ends of the rod supports 18 such that the electrode support rods 20 are arranged at regular intervals and extend in parallel to the support base 16. Two power supply rods 22 and 23 lead outward from both ends of the outer casing 14, with one end of each power supply rod 22, 23 being inserted in the metallic mixture 12. One or more pairs of trigger electrodes 24 are provided at the inner ends of the two power supply rods 22 and 23, and at both ends of the electrode support rods 20 in such a way that the electrode support rods 20, trigger electrodes 24, and the power supply rods 22 and 23 are arranged along a line. In such a case, the intervals between the trigger electrodes 24 range from 1 mm to 100 mm.

FIG. 5 shows a capsule according to the fifth embodiment of the present invention. As shown in the drawing, the general shape of the capsule 10 according to the fifth embodiment is similar to that of the fourth embodiment, but the capsule 10 of the fifth embodiment is altered to lead the two power supply rods 22 and 23 to the outside through one end of the outer casing 14. The construction and operation of the capsule 10 according to the fifth embodiment remains the same as that described in the third embodiment, and further explanation is thus deemed unnecessary.

In the present invention, it is preferred that the rapidly expanding metallic mixture 12 is further added with a water repellent including oil or an inorganic preservative. Thereby, corrosion or oxidation of the metal salt or the metal powder can be prevented under moisture or air atmosphere during storage thereof. With the aim of prevention of corrosion and oxidation of the metallic mixture 12, particles in the mixture may be coated with a resin and formed to the volume of 0.1–100 $mm^3$. The materials, such as oil, inorganic preservative or resin, are melted and vaporized at high temperatures, and have no influence on the oxidation of the metal powder by the metal salt.

The use and operation of the capsule according to the present invention will be described in detail herein below with reference to FIG. 6.

When it is desired to use a metallic mixture capsule 10 of the present invention for blasting the target material 42, such as a rock mass, in midtown construction works, midtown public works, or rock-blasting works, a capsule installation hole 44 is formed on the target material 42 prior to inserting the capsule 10 into the hole 44, as shown in FIG. 6. After the insertion of the capsule 10 into the hole 44, the remaining space of the hole 44 is plugged with an appropriate plugging material, such as cement mortar.

The capsule 10 is electrically connected to the external high voltage generator through the electric wires 25, as shown in FIG. 6. In the high voltage generator, the power distributor 32 distributes input AC power 30 to the DC-multiplying booster 34 as well as the relays R1 and R2 of the momentary switch 38. The DC-multiplying booster 34 multiplies and DC boosts the input AC power distributed thereto, and the boosted DC voltage is charged as a high level of voltage in the charger 36. Such a charging operation of the high voltage generator is controlled by two control switches, that is, a first control switch SW1 which selectively closes the circuit between the input AC power 30 and the power distributor 32, and a second control switch SW2 which selectively closes the circuit between the power distributor 32 and the DC-multiplying booster 34.

When the charger 36 is fully charged with high voltage, a relay switch SW3 is turned on to close the momentary switch 38. The momentary switch 38 thus momentarily supplies the charged high voltage to the power supply rods 22 and 23 of the capsule 10 through the connector 40 and the electric wires 25.

In such a case, it is necessary to use a high-tension large-capacity charger providing high voltage capable of inducing the arc discharge between the trigger electrodes 24 as the charger 36, and to use a high-tension large-current switch as the momentary switch 38.

When the high voltage is applied to the power supply rods 22 and 23, the oxidation reaction is initiated by arc discharge. Under high temperature and high voltage expansion by oxidation heat of the metal powder, the target material 42 is fractured. The leakage current (arc) is induced between adjacent trigger electrodes 24, and the high temperature required for oxidation is generated instantaneously (e.g., high temperature of about 1,500° C. or more is generated in about 1/1000 sec.). Thus the rapidly expanding metallic mixture 12 in the outer casing 14 is instantaneously (e.g., 1/1,000–1/10,000 sec.) oxidized and the metal oxidation heat occurs at high temperatures (about 3,000–30,000° C.). Such high temperature vaporization expands the products and volume expansion force under high pressure (40,000–60,000 $kg/cm^2$) is generated. The target material 42 is thus blasted in a very short time by such vaporization expansion force.

Such rapid expansion of the volume in the metallic mixture reduces the internal temperature without delay. Then, while the products after oxidation (metal and metal oxide) are changed in state from gas to solid, the volume is rapidly reduced. Hence, when the target material 42 is fractured by high expansion force in a very short time, scattering of fractured fragments, and the explosive sound and explosive vibration created are greatly reduced, thus securing safety and improving work efficiency while blasting.

As described above, the present invention provides a structure of a capsule for a rapidly expanding metallic mixture. The capsule structure of the present invention easily provides a triggering temperature required for initiation of an oxidation reaction of a rapidly expanding metallic mixture that is oxidized at high temperatures of 700° C. or more (about 1,500° C.). Particularly when two or more pairs of trigger electrodes are arranged between two power supply rods in the capsule in a series, it is possible to induce effective arc discharge as well as generating sparks at several points even with the use of low voltage. The capsule structure thus easily and effectively triggers an oxidation reaction of the metallic mixture even in the case of a long capsule.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A structure of a capsule for a rapidly expanding metallic mixture including an outer casing, a rapidly expanding mixture in said outer casing, a pair of main trigger electrodes embedded in said metallic mixture and a pair of power supply rods electrically connected to said main trigger electrodes, further comprising:

one or more trigger electrode support rods arranged between said main trigger electrodes such that the trigger electrode support rods are linearly aligned with the main trigger electrodes, with an additional trigger electrode provided at each end of said trigger electrode support rods.

2. The capsule structure as set forth in claim 1, wherein the trigger electrode support rods are fixed to ends of rod supports perpendicularly extending from an insulating support base arranged in the metallic mixture such that the electrode support rods are arranged at regular intervals and extend in parallel to the insulating support base.

3. The capsule structure as set forth in claim 2, wherein a resistance wire is connected between adjacent trigger electrodes so as to induce arc discharge between the trigger electrodes by rapid heating, melting and evaporation when high voltage is applied to the trigger electrodes.

4. The capsule structure as set forth in claim 2, wherein an electrolyte is added to the metallic mixture and the trigger electrodes are arranged at intervals of 1–100 mm, thus readily inducing arc discharge between the trigger electrodes.

5. The capsule structure as set forth in claim 2, wherein said power supply rods lead outward from both ends of said outer casing, respectively.

6. The capsule structure as set forth in claim 2, wherein the rapidly expanding metallic mixture comprises a metal powder mixed at a weight ratio of 0.1:99.9–99.9:0.1 with a metal salt responsible for oxidation of the metal powder at high temperatures of 700° C. or more (about 1,500° C.).

7. The capsule structure as set forth in claim 1, wherein an electrolyte is added to the metallic mixture and the trigger electrodes are arranged at intervals of 1–100 mm, thus readily inducing arc discharge between the trigger electrodes.

8. The capsule structure as set forth in claim 1, wherein the rapidly expanding metallic mixture comprises a metal powder mixed at a weight ratio of 0.1:99.9–99.9:0.1 with a metal salt responsible for oxidation of the metal powder at high temperatures of 700° C. or more (about 1,500° C.).

9. The capsule structure as set forth in claim 8, wherein the metal salt is selected from among metal nitrates, metal oxides, metal hydroxides, metal carbonates, metal sulfates, and combinations thereof.

10. The capsule structure as set forth in claim 8, wherein the metal powder is selected from among aluminum (Al), sodium (Na), potassium (K), lithium (Li), magnesium (Mg), calcium (Ca), manganese (Mn), barium (Ba), chromium (Cr), silicon (Si), and combinations thereof.

11. The capsule structure as set forth in claim 8, wherein the rapidly expanding metallic mixture is further added with oil or an inorganic preservative, to prevent oxidation of the metal powder during storage.

12. The capsule structure as set forth in claim 8, wherein the rapidly expanding metallic mixture is coated with a resin and formed to a volume of 0.1–100 $mm^3$, to prevent oxidation of the metal powder during storage.

13. The capsule structure as set forth in claim 1, wherein a resistance wire is connected between adjacent trigger electrodes so as to induce arc discharge between the trigger electrodes by rapid heating, melting and evaporation when high voltage is applied to the trigger electrodes.

14. The capsule structure as set forth in claim 1, wherein said power supply rods lead outward from both ends of said outer casing, respectively.

* * * * *